US005201847A

United States Patent [19]

Whidden

[11] Patent Number: 5,201,847

[45] Date of Patent: Apr. 13, 1993

[54] SHROUD DESIGN

[75] Inventor: Graydon L. Whidden, Orlando, Fla.

[73] Assignee: Westinghouse Electric Corp., Pittsburgh, Pa.

[21] Appl. No.: 796,568

[22] Filed: Nov. 21, 1991

[51] Int. Cl.[5] ..... F01D 5/08

[52] U.S. Cl. ..... 415/177

[58] Field of Search ..... 415/115, 116, 175, 176, 415/177, 178

[56] References Cited

U.S. PATENT DOCUMENTS 2,648,519 8/1953 Campini ..... 415/177
4,329,113 5/1982 Ayache et al. ..... 415/116
4,762,462 8/1988 Lardellier ..... 415/177

FOREIGN PATENT DOCUMENTS 231330 10/1986 Japan ..... 415/177

*Primary Examiner*—John T. Kwon

[57] ABSTRACT

A gas turbine of the type having cooling air supplied to cool the outer surfaces of the shrouds of the turbine vanes is provided with roughness elements disposed upon the outer surfaces of the shrouds. The roughness elements enhance the heat transfer characteristics of the shroud by increasing the surface area of the shroud and enhance the efficiency of the cooling air by increasing the turbulence between the cooling air and the shroud.

18 Claims, 4 Drawing Sheets

SHROUD DESIGN

FIELD OF THE INVENTION

The present invention relates to gas turbines. More specifically, the present invention relates to an improved shroud design for increasing the efficiency of the heat transfer between the shroud element and the cooling air used to maintain the operating temperature of the shroud.

DESCRIPTION OF THE PRIOR ART

The operation of gas turbines is well known. Recently, the operating temperature of the turbine has been increased in order to improve the efficiency of the engine and derive the most use from the fuel. The temperature limit of the turbine is limited due to the materials of construction used for the various components of the turbine which are exposed to these hot combustion gases.

A portion of the annular gas flow path in the turbine section of a gas turbine is formed by a multitude of vane segments circumferentially arrayed around the rotor. Each vane segment is bounded by a shroud assembly, usually defined as two shrouds, an inner and an outer shroud. Since the vane and shroud assembly are directly exposed to the combustion gases, they must be cooled, usually with cooling air which is bled from another section of the turbine.

In the past, engineering efforts have gone into designing various air paths for the cooling air to traverse through the shrouds and vanes in order to maximize the efficient use of the cooling air. These efforts included hollow vane designs such as those discussed in U.S. Pat. No. 3,628,880 to Smuland et al., and designs for redirecting the air flow within the shroud assembly as discussed in U.S. Pat. No. 4,573,865 to Hsia et al. and in U.S. Pat. No. 4,902,198 to North.

A typical cooling design for the shroud assembly incorporates impingement cooling techniques. During impingement cooling, cooling air is directed towards the outer surface of the shroud, that is, the surface opposite the side facing the hot combustion gases. The cooling air is usually supplied by the compressor, and in current impingement designs a relatively large volume of such cooling air is required to properly maintain the material surface temperatures. Therefore, the compressor must be operated at a higher output level to supply this additional cooling air, thus reducing overall engine efficiency.

While the above design considerations have achieved improvements in cooling design, operating efficiencies are far from being maximized. One area that has been unfulfilled by the prior art is that of designing the shroud surface as such, so as to increase heat transfer between the shroud and the cooling air. For example, the prior art assumes a smooth outer shroud surface across which the cooling air passes. What remains unfulfilled by the prior art is a new shroud design to increase efficient use of the cooling air right at the shroud surface. As a result, the present invention is directed to a novel shroud outer surface design which increases the efficiency of the impinging cooling air.

SUMMARY OF THE INVENTION

The present invention provides an improved shroud design for use within a gas turbine. The gas turbine has a combustion section which produces hot gas and a turbine section which has a plurality of vanes disposed therein. The vanes are bounded by a shroud. Each shroud has an outer and an inner surface, and the turbine section is capable of directing the flow of hot gas over the inner surfaces of the shrouds. The turbine section is also capable of directing cooling air to flow over the outer surfaces of the shrouds. The present invention provides for a grid pattern of roughness elements on at least one of the outer surfaces of the shrouds, the uneven grid pattern being designed to increase interaction between the cooling air and the shroud surface, thereby promoting heat transfer between the shroud and cooling air. Preferably the grid pattern is disposed upon the outer surface of both the inner and outer shroud which holds each vane.

The grid pattern can be of any overall shape so that it imparts a non-smooth surface onto the outer surface of the shroud. Typical shapes for the roughness elements which can be utilized to make the grid pattern are rectangles, pyramids, and spherical shapes.

DESCRIPTION OF THE PREFERRED EMBODIMENT

Figure 1:
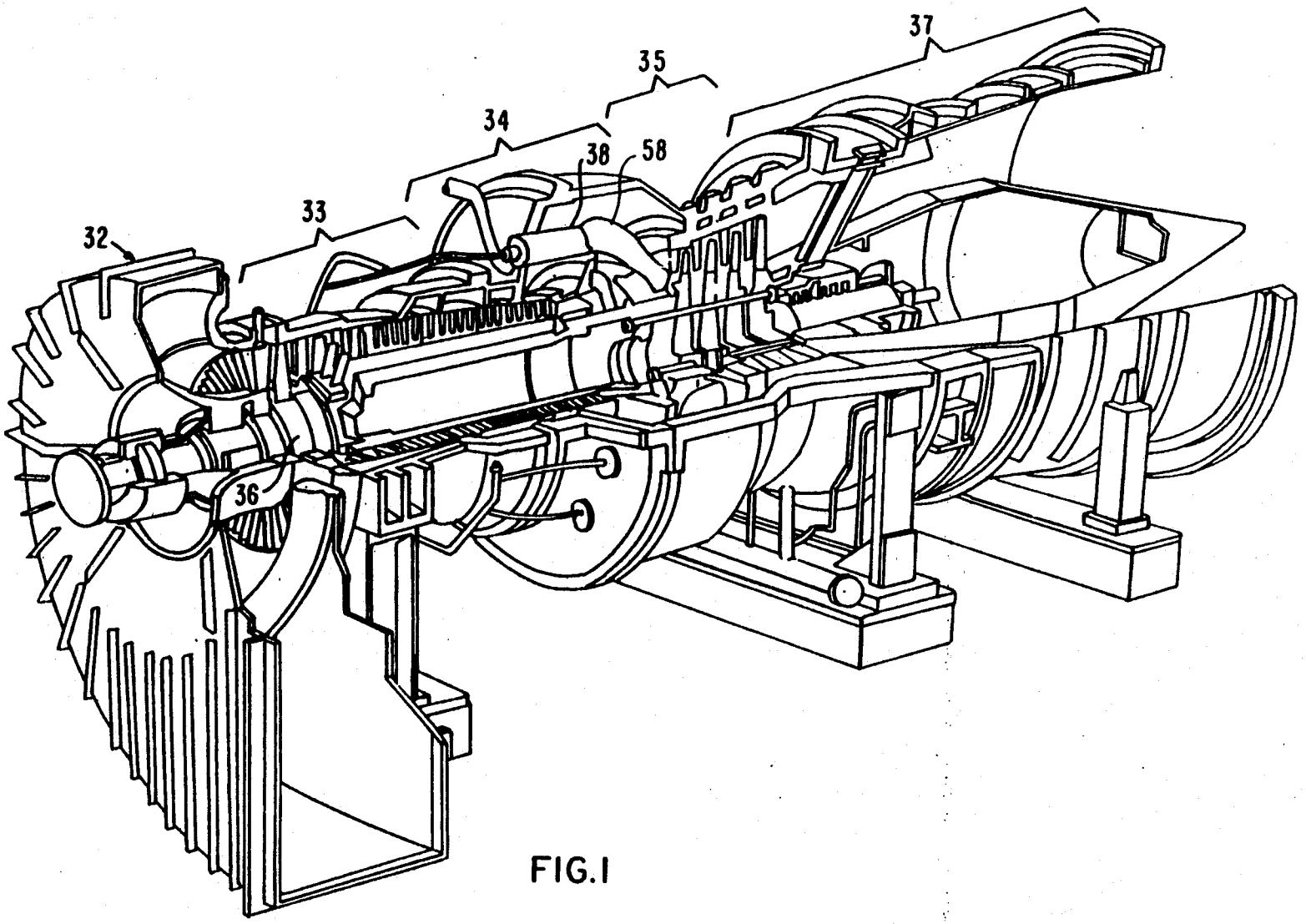
FIG. 1 is an isometric view, partially cut away, of a gas turbine.

There is shown in FIG. 1 a gas turbine. The major components of the gas turbine are the inlet section 32, through which air enters the gas turbine; a compressor section 33, in which the entering air is compressed; a combustion section 34 in which the compressed air from the compressor section is heated by burning fuel in combustors 38; a turbine section 35, in which the hot compressed gas from the combustion section is expanded, thereby producing shaft power; and an exhaust section 37, through which the disposed rotor 36 extends through the gas turbine.

Figure 2:
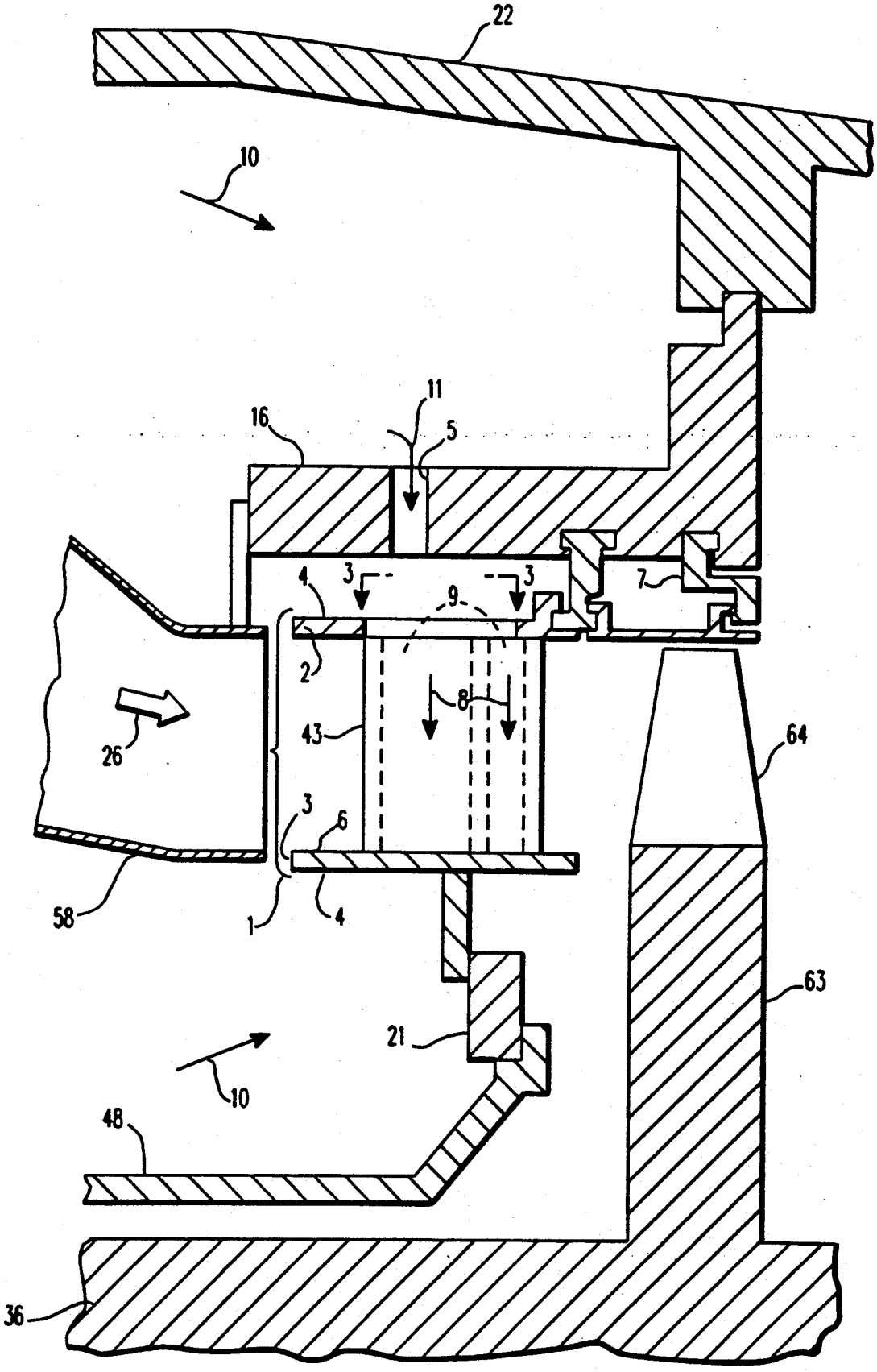
FIG. 2 is a cross-section of a portion of the turbine section of the gas turbine in the vicinity of the first row of vanes.

The turbine section 35 of the gas turbine is comprised of alternating rows of stationary vanes and rotating blades. Each row of vanes is arranged in a circumferential array around the rotor 36. FIG. 2 shows a portion of the turbine section in the vicinity of the first row vane assembly. Typically, the vane assembly is comprised of a number of vane segments 1. Each vane segment 1 is comprised of a vane 43 having an inner shroud 3 and outer shroud 2 formed on its inboard end. Alternatively, each vane segment 1 may be formed by two or more vane air foils having common inner and outer shrouds.

As shown in FIG. 2, the vane segments are encased by a cylinder 16, referred to as a blade ring. Also, the vane segments 1 encircle an inner cylinder structure 48. The inner cylinder structure 48 is connected to the inner shroud 3 via ring 21. The vane segments 1 are fixed to the cylinder 16 at the outer shroud 2 via assembly 7. The cylinder 16 is in turn connected to the turbine outer cylinder 22. The blades 64 are connected to the rotor 36 via the disk portion 63.

During operation, hot compressed gas 26 from the combustion section is directed to the turbine section by duct 58. The flow of hot compressed gas 26 is contained between the outer shroud 2 and the inner shroud 3 and impinges upon the inner surfaces 6 of the shrouds.

The outer shroud 2, the inner shroud 3, the vane 43, and the blades 64 are exposed to extremely high temperatures during the operation of the turbine. Therefore, these components must be cooled so that their strength is not compromised due to the high temperatures and resulting thermal expansion. The process of decreasing the temperature of these turbine components usually involves the use of directing cooling air 10, for instance from the compressor section, a portion 11 of which is directed through a gap 5 towards the components. The distance between the cooling air jet, as defined by the lower edge of gap 5, to the outer surface 4 of the shrouds is from about 2.5 cm (1 in.) to about 5 cm (2 in.). The cooling air portion 11 impinges upon the outer surface 4 of the outer shroud 2. The cooling air 10 also is directed to impinge upon the outer surface 4 of the inner shroud 3. After the cooling air 10 flows over the outer surfaces 4 it is usually diverted through the cavities 9 in the vane 43 as vane cooling air 8. Various cavity 9 designs exist in order to redirect the flow of the cooling air throughout the vane segment 1 region in order to optimize the cooling process. The cavity 9 design is not considered to be part of this invention, which invention relates to the design of the outer surfaces 4 on the outer portion of the inner and outer shrouds.

In a normal turbine operation environment, the temperature of the hot gas 26 flowing over the shrouds is approximately 900° C. (1650° F.). Cooling air 10, 11 which is typically at a temperature of approximately 400° C. (750° F.) impinges the outer surfaces 4, which surfaces are opposite to the inner surfaces exposed to the hot gas 26. As a result, the average temperature of the shrouds themselves is approximately 700° C. (1300° F.).

Various designs exist for the manipulation and diversion of the cooling air flow through the outer shroud 2, the inner shroud 3, the vane 43. Such patents as U.S. Pat. No. 4,573,865 to Hsia et al., U.S. Pat. No. 4,902,198 to North, and U.S. Pat. No. 3,628,880 to Smuland et al. all relate to the art of directing the flow of the cooling air to increase the efficiency of the cooling process. These designs all employ a smooth outer surface for the shroud.

Figure 3:
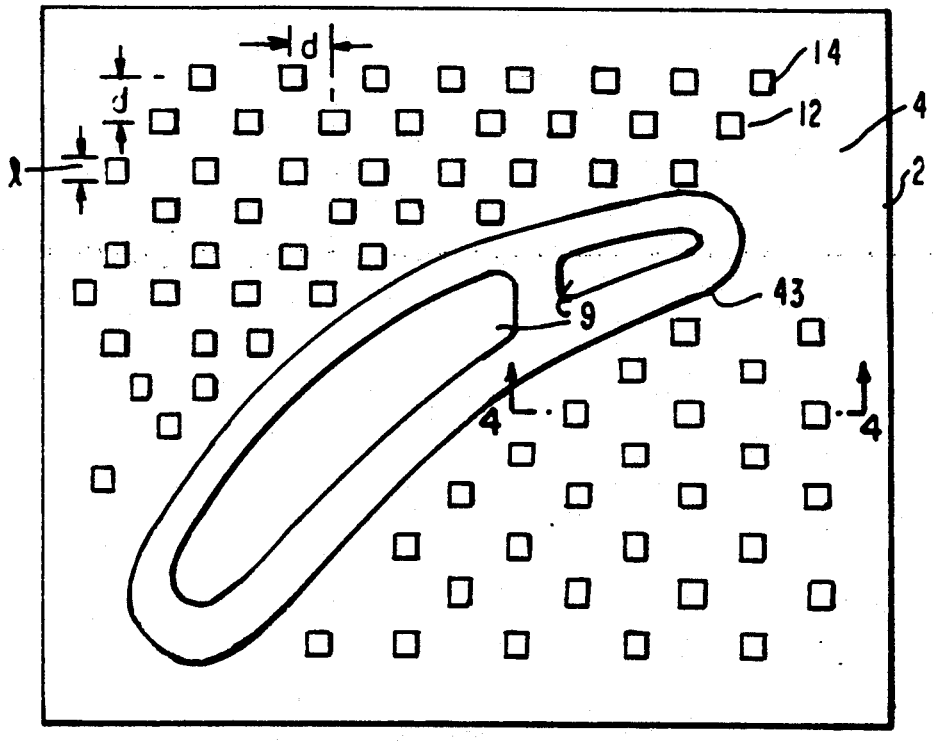
FIG. 3 is a top view of the outer shroud and vane assembly taken through line 3—3 of FIG. 2.

Referring to FIG. 3, the outer surface 4 of a shroud, in this case the outer shroud 2, is shown. The outer shroud 2 encases the vane 43 which in this case is shown with a typical two cavity design, as shown at numeral 9. The outer surface 4 of the shroud is typically manufactured as a smooth surface. According to the present invention, the outer surface 4 of the shroud is characterized by having a grid 12 disposed upon the outer surface 4. Although shown on the outer surface 4 of the outer shroud 2 in FIG. 3, the grid 12 can also be disposed upon the outer surface 4 of the inner shroud 3 although the increased cooling benefits may not be as great as those for the outer shroud 2. The use of such a grid 12 can be made upon a shroud outer surface itself or on the surface of an air directing cooling device disposed upon the shroud outer surface.

The outer surface 4 preferably has a varying thickness, being wider at the edges of the shroud and near the vane 43, while being narrower in the area bounded by the vane 43 and the shroud edges. This varying thickness design enhances the cooling of the shroud while ensuring structural stability throughout the shroud. The impinging cooling air is usually directed to the narrower thickness areas of the shroud. The grid 12 preferably comprises the area of the outer surface 4 which is exposed to directly impinging cooling air, that is, the narrower width portion of the shroud. The grid 12 is preferably maintained from about 0.6 cm (0.25 in.) to about 1.2 cm (0.5 in.) from the edge of the vane 43 for vane structural stability. The grid 12 is also preferably maintained from about 0.6 cm (0.25 in.) to about 1.2 cm (0.5 in.) from the shroud edges for shroud structural stability.

The grid 12 can be a structured repeating pattern or it can be a random pattern of shapes, shown as roughness elements 14. The grid 12 is generically defined as a series of roughness elements 14 which elements have a common aspect of imparting variable heights to the outer surface 4. The grid 12 is preferably designed such that impinging air does not have a direct uninterrupted flow pattern directed towards the cavity 9 within the vane 43. The grid 12 can also be a series of rows as opposed to individual elements, where the rows are preferably aligned such that they run parallel to the length of the vane 43 so that impinging air is directed away from the cavity 9. The grid 12 therefore enhances the thermal heat transfer characteristics of the shroud. As opposed to a smooth outer surface 4, the grid 12 provides increased surface area between the cooling air and the outer surface 4. This increase in surface area results in an increase in the rate at which the outer surface 4 (and therefore the shroud) can be cooled.

The grid 12 not only increases the surface area of the outer surface 4, but the grid 12 also increases the level of turbulence in the impinging jet of cooling air striking the outer surface 4. This increased turbulence is beneficial to the transfer of heat from the outer surface 4 to the cooling air impinging on the outer surface 4.

The grid 12 is either machine attached, cast into, or machined into the outer surface 4. Preferably, the grid 12 is made of the same material as the shroud. The grid 12 should have a thermal conductivity at least as great or greater than that of the shroud.

Figure 4:
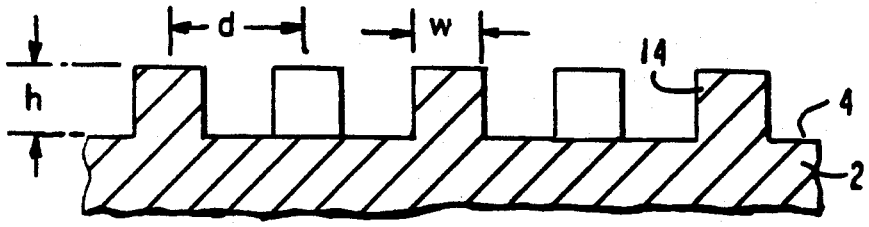
FIGS. 4, 5 and 6 show the cross-section of a portion of the shroud taken through line 4—4 of FIG. 3, illustrating the respective surfaces of the shroud, in accordance with the invention with different element shapes.
Figure 5:
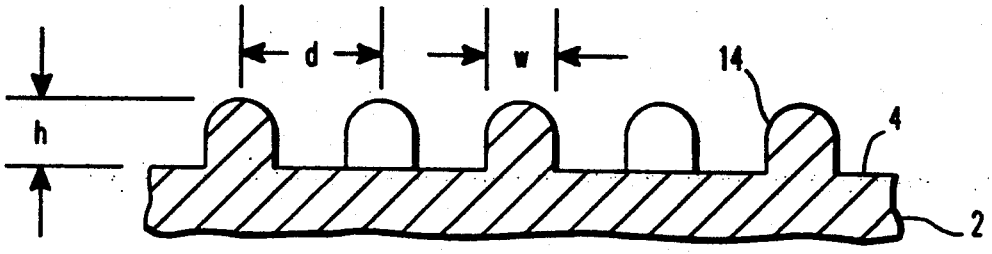
Figure 6:
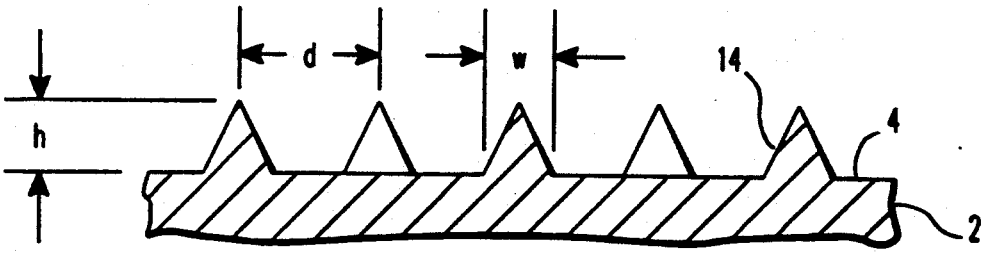

An example of a representative grid 12 pattern is shown in FIG. 4. FIG. 4 depicts a grid 12 pattern which consists of a uniform rectangular pattern of roughness elements 14 disposed onto the shroud, shown as the outer shroud 2. The grid 12 can also comprise elements shaped as pyramid, spherical and other geometric shapes as shown, correspondingly, in FIGS. 5 and 6.

The dimensions of the roughness elements 14 can be varied according to air flow velocity, air flow temperature, distance between air flow and the elements, and other operating parameters. Typically the elements are laid out in a regularly repeating row pattern which is designed according to a pitch (d) to height (h) ratio. This ratio is defined as the distance between the centers of each adjacent row of elements divided by the average height of the elements. Preferred ratios are from about 1 to about 30, with the height ranging from about 0.04 cm (0.015 in.) to about 0.3 cm (0.13 in.). The elements can also be placed in a circular pattern as opposed to a row pattern. Further, the elements can be placed in a non-uniform random pattern. If the grid 12 pattern is not in a uniform row fashion, then the pitch (d) is defined as the average distance between two neighboring elements. This can be determined, for example, by choosing about ten elements and averaging the distance between those elements and their closest neighboring element. The height can also be averaged if nonuniform height elements are to be used. The width (w) of the elements can vary and is preferably less than the height of the elements. The length (l) of the elements can vary. The length can be as long as the length of the vane 43 if a row pattern is to be employed, generally ranging from about 10 cm (4 in.) to about 15 cm (6 in.). Preferred dimensions for the width are from about 0.04 cm (0.015 in.) to about 0.3 cm (0.13 in.). Preferred dimensions for the length are from about 0.04 cm (0.015 in.) to about 5 cm ( 2 in.), most preferably from about 0.04 cm (0.015 in.) to about 0.3 cm (0.13 in.).

Although the above description has been directed towards exemplary roughness element grid patterns, the principles disclosed herein are equally applicable to other roughness element grid patterns. Moreover, it is understood that although the above description has been directed to a preferred embodiment of the invention, other modifications and variations known to those skilled in the art may be made without departing from the spirit and scope of the invention as set forth in the appended claims.

What is claimed is:

1. A gas turbine comprising:

a) a combustion section having a means for producing hot gas;

b) a turbine section having a plurality of vanes bounded by a shroud disposed therein, each shroud having an outer and inner surface, the turbine section having means for directing hot gas to flow over at least one of the inner surfaces and means for directing impinging cooling air to flow over at least one of the outer surfaces; and c) a grid pattern of roughness elements on at least one of the outer surfaces wherein the elements have a pitch to height ratio of from about 1 to about 30 and wherein the height of the elements is from about 0.04 cm (0.015 in.) to about 0.3 cm (0.13 in.).

2. The turbine of claim 1 wherein the elements are selected from the group consisting of rectangular shapes, spherical shapes, and pyramid shapes.

3. The turbine of claim 1 wherein the shroud is an outer shroud and the distance between the impinging cooling air to the outer shroud is from about 2.5 cm (1 in. ) to about 5 cm (2 in.).

4. The turbine of claim 1 wherein the elements are at least about 1.2 cm (0.5 in) from the edge of the vane.

5. The turbine of claim 1 wherein the elements are fixed in a random order.

6. The turbine of claim 1 wherein the grid pattern is located directly in the path of the impinging air flow.

7. The turbine of claim 1 wherein the width and length of the elements is from about 0.04 cm (0.015 in.) to about 0.3 cm (0.13 in.).

8. An improved shroud of a gas turbine for increasing the heat transfer characteristics of the shroud, the shroud bounding a vane, the shroud having an outer surface containing a grid of roughness elements wherein the elements have a pitch to height ratio of from about 1 to about 30 and wherein the height of the elements is from about 0.04 cm (0.015 in.) to about 0.3 cm (0.13 in.).

9. The shroud of claim 8 wherein the roughness elements are selected from the group consisting of rectangular shapes, spherical shapes, and pyramid shapes.

10. The shroud of claim 8 wherein the shroud is an outer shroud.

11. The shroud of claim 8 wherein the roughness elements are fixed in a random order.

12. The shroud of claim 8 wherein the elements are at least about 1.2 cm (0.5 in.) from the edge of the vane.

13. The shroud of claim 8 wherein the width and length of the elements is from about 0.04 cm (0.015 in.) to about 0.3 cm (0.13 in.).

14. In a shroud assembly within a gas turbine through which hot gas flows, having a vane, the vane being bounded by a shroud with an outer surface, the hot gas flowing over the vane, cooling air being supplied to the outer surface of the shroud, the improvement comprising a grid pattern of roughness elements on the outer surface of the outer shroud wherein the elements have a pitch to the height ratio of from about 1 to about 30 and wherein the height ratio of from about 1 to about 30 and wherein the height of the elements is from about 0.04 cm (0.015 in.) to about 0.3 cm (0.13 in.).

15. The shroud of claim 14 wherein the elements are selected from the group consisting of pyramid shapes, rectangular shapes, and spherical shapes.

16. The shroud of claim 14 wherein the elements are fixed in a random order.

17. The shroud of claim 14 wherein the elements are at least about 1.2 cm (0.5 in.) from the edge of the vane.

18. The shroud of claim 14 wherein the width and length are from about 0.04 cm (0.015 in.) to about 0.3 cm (0.13 in.).

* * * * *